US010156394B2

(12) United States Patent
Mitchell

(10) Patent No.: US 10,156,394 B2
(45) Date of Patent: Dec. 18, 2018

(54) AIR FLOW AND DRAINAGE SYSTEM FOR ICE MAKER

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/355,161

(22) Filed: Nov. 18, 2016

(65) Prior Publication Data

US 2018/0142933 A1 May 24, 2018

(51) Int. Cl.

| | |
|---|---|
| ***F25C 5/08*** | (2006.01) |
| ***F25C 1/04*** | (2018.01) |
| ***F25C 5/18*** | (2018.01) |
| ***F25C 5/00*** | (2018.01) |
| ***F25C 5/182*** | (2018.01) |
| ***F25C 5/20*** | (2018.01) |

(52) U.S. Cl.

CPC ..... *F25C 5/08* (2013.01); *F25C 1/04* (2013.01); *F25C 5/182* (2013.01); *F25C 5/22* (2018.01); *F25C 2400/10* (2013.01); *F25C 2500/06* (2013.01)

(58) Field of Classification Search

CPC .... F25C 5/08; F25C 5/182; F25C 1/04; F25C 2500/06; F25C 2400/10; F25D 11/00

See application file for complete search history.

(56) References Cited

U.S. PATENT DOCUMENTS

| | | | | |
|---|---|---|---|---|
| 7,392,665 | B2 | 7/2008 | Lee et al. | |
| 7,681,406 | B2 * | 3/2010 | Cushman | F25D 17/065 62/200 |
| 8,136,367 | B2 | 3/2012 | Froelicher et al. | |
| 8,397,532 | B2 | 3/2013 | Mitchell et al. | |
| 8,794,014 | B2 | 8/2014 | Kulkarni et al. | |
| 8,833,093 | B2 * | 9/2014 | Tarr | G05D 23/19 62/135 |
| 9,115,922 | B2 * | 8/2015 | Boarman | F25C 5/005 |
| 9,175,893 | B2 | 11/2015 | Junge et al. | |
| 9,200,828 | B2 * | 12/2015 | Mitchell | F25C 5/005 |
| 9,303,913 | B2 * | 4/2016 | Ha | F25D 17/065 |
| 9,377,233 | B2 | 6/2016 | Boehringer et al. | |
| 9,915,459 | B2 * | 3/2018 | Wu | F25C 1/18 |

(Continued)

*Primary Examiner* — Kun Kai Ma

(74) *Attorney, Agent, or Firm* — Dority & Manning, P.A.

(57) ABSTRACT

An ice making appliance includes a sealed icebox compartment including a heat exchange opening with an ice maker disposed within the sealed icebox compartment. The ice maker includes a heat exchanger positioned at the heat exchange opening of the icebox compartment and a mold body configured for receiving liquid water and forming ice. The ice making appliance also includes a defrost conduit having a first portion positioned below the mold body, the first portion of the defrost conduit extends generally perpendicularly to a vertical direction and slopes towards a second portion of the defrost conduit, the second portion of the defrost conduit extends along the vertical direction between the first portion of the defrost conduit and a drain conduit. The ice making appliance also includes an air circulation conduit providing air circulation within the sealed icebox compartment.

11 Claims, 7 Drawing Sheets

(56) References Cited

U.S. PATENT DOCUMENTS

2005/0210909 A1* 9/2005 Kim ..... F25D 17/065 62/340
2006/0096310 A1* 5/2006 Lee ..... F25D 17/06 62/348
2008/0148761 A1* 6/2008 Venkatakrishnan .. F25D 17/065 62/340
2008/0156026 A1* 7/2008 Shin ..... F25C 1/04 62/353
2010/0126185 A1* 5/2010 Cho ..... F25C 5/005 62/3.63
2010/0326112 A1* 12/2010 Prabhakar ..... F25D 21/14 62/259.1
2012/0023997 A1* 2/2012 Jung ..... F25C 5/005 62/340
2012/0031138 A1* 2/2012 Hunter ..... F25C 1/225 62/347
2012/0277906 A1* 11/2012 Fassberg ..... A23G 9/045 700/244
2013/0152617 A1* 6/2013 Oh ..... F25C 1/24 62/351
2013/0167575 A1* 7/2013 Hong ..... F25C 1/00 62/344
2013/0227983 A1* 9/2013 Jeong ..... F25D 23/061 62/285
2014/0150467 A1* 6/2014 Boarman ..... F25B 21/02 62/3.63
2014/0150486 A1* 6/2014 Boarman ..... F25B 21/02 62/344
2014/0150487 A1 6/2014 Boarman
2014/0260407 A1* 9/2014 Boehringer ..... F25C 5/005 62/344
2015/0135758 A1* 5/2015 Miller ..... F25C 1/12 62/340
2016/0025399 A1* 1/2016 Miller ..... F25D 21/14 62/344
2016/0370052 A1* 12/2016 Yang ..... F25D 21/14

* cited by examiner

AIR FLOW AND DRAINAGE SYSTEM FOR ICE MAKER

FIELD OF THE INVENTION

The present subject matter relates generally to ice making appliances and/or refrigeration appliances including features for making ice.

BACKGROUND OF THE INVENTION

Generally, refrigerator appliances include a cabinet that defines a fresh food chamber for receipt of food items for storage. Many refrigerator appliances further include a freezer chamber for receipt of food items for freezing and storage. Certain refrigerator appliances include an ice maker. In order to produce ice, liquid water is directed to the ice maker and frozen. Accordingly, refrigerator appliances having both an ice maker and a freezer chamber commonly include the ice maker in the freezer chamber since both operate at or around the same general temperatures. However, in many currently utilized refrigerator appliances, the freezer chamber is positioned below the fresh food chamber, which is sometimes referred to as a bottom freezer. In such refrigerator appliances, locating the ice maker in the bottom freezer may be inconvenient or otherwise not desired.

Accordingly, an ice making system for a refrigerator appliance with features permitting operation remote from the freezer chamber would be useful.

BRIEF DESCRIPTION OF THE INVENTION

An ice making appliance includes a sealed icebox compartment including a heat exchange opening with an ice maker disposed within the sealed icebox compartment. The ice maker includes a heat exchanger positioned at the heat exchange opening of the icebox compartment and a mold body configured for receiving liquid water and forming ice. The ice making appliance also includes a defrost conduit having a first portion positioned below the mold body, the first portion of the defrost conduit extends generally perpendicularly to a vertical direction and slopes towards a second portion of the defrost conduit, the second portion of the defrost conduit extends along the vertical direction between the first portion of the defrost conduit and a drain conduit. The ice making appliance also includes an air circulation conduit providing air circulation within the sealed icebox compartment. Additional aspects and advantages of the invention will be set forth in part in the following description, or may be apparent from the description, or may be learned through practice of the invention.

In accordance with one embodiment, an ice making appliance is provided. The ice making appliance includes an icebox compartment including a heat exchange opening with an ice maker disposed within the icebox compartment. The ice maker includes a heat exchanger positioned at the heat exchange opening of the icebox compartment and a mold body configured for receiving liquid water and forming ice. The ice making appliance also includes a defrost conduit having a first portion positioned below the mold body, the first portion of the defrost conduit extends generally perpendicularly to a vertical direction and slopes towards a second portion of the defrost conduit, the second portion of the defrost conduit extends along the vertical direction between the first portion of the defrost conduit and a drain conduit.

In accordance with another embodiment, an ice making appliance is provided. The ice making appliance includes a sealed icebox compartment including a heat exchange opening, an ice maker disposed within the sealed icebox compartment, the ice maker has a heat exchanger positioned at the heat exchange opening of the sealed icebox compartment. The ice making appliance also includes an air circulation conduit providing air circulation within the sealed icebox compartment.

In accordance with another embodiment, a refrigerator appliance is provided. The refrigerator appliance includes a cabinet defining a fresh food chamber and a freezer chamber, the freezer chamber positioned below the fresh food chamber along a vertical direction, the cabinet also includes a sealed icebox compartment outside of the freezer chamber and proximate to the fresh food chamber. The sealed icebox compartment includes a heat exchange opening. The refrigerator appliance also includes an ice maker disposed within the sealed icebox compartment, the ice maker including a heat exchanger positioned at the heat exchange opening of the icebox compartment and a mold body configured for receiving liquid water and forming ice. The refrigerator appliance also includes a defrost conduit with a first portion positioned below the mold body, the first portion of the defrost conduit extends generally perpendicularly to a vertical direction and slopes towards a second portion of the defrost conduit, the second portion of the defrost conduit extends along the vertical direction between the first portion of the defrost conduit and a drain conduit, and an air circulation conduit providing air circulation within the sealed icebox compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
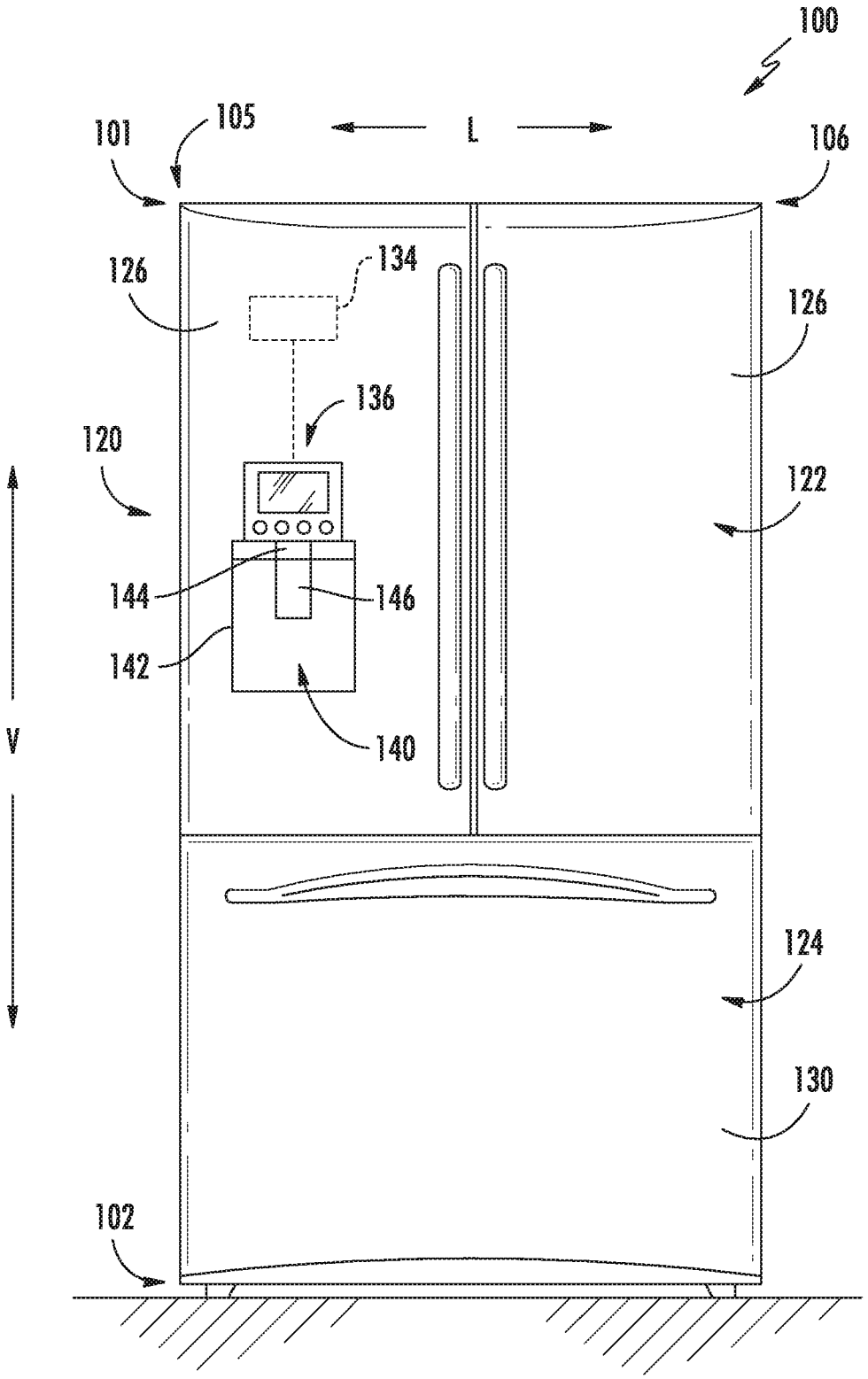
FIG. 1 provides a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of an exemplary embodiment of a refrigerator appliance 100. Refrigerator appliance 100 extends between a top portion 101 and a bottom portion 102 along a vertical direction V. Refrigerator appliance 100 also extends between a first side portion 105 and a second side portion 106 along a lateral direction L perpendicular to the vertical direction V. A transverse direction T (FIG. 2) may additionally be defined perpendicular to the vertical and lateral directions V, L.

Refrigerator appliance 100 includes a cabinet or housing 120 defining an upper fresh food chamber 122 and a lower freezer chamber 124 arranged below the fresh food chamber 122 on the vertical direction V. As such, refrigerator appliance 100 is generally referred to as a "bottom mount refrigerator." In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides) or any other types of appliance as well. Consequently, the description set forth herein is for illustrative purposes only and is not intended to limit the invention in any aspect.

Refrigerator doors 126 are rotatably hinged to an edge of housing 120 for accessing fresh food chamber 122. Refrigerator doors 126 rotate perpendicularly to the vertical direction V, e.g., through a plane defined by the lateral direction L and the transverse direction T. It should be noted that while two doors 126 in a "French door" configuration are illustrated, any suitable arrangement of doors utilizing one, two or more doors is within the scope and spirit of the present disclosure. A freezer door 130 is arranged below refrigerator doors 126 for accessing freezer chamber 124. In the exemplary embodiment, freezer door 130 is coupled to a freezer drawer (not shown) slidably coupled within freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections, etc. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within the door 126. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

Figure 2:
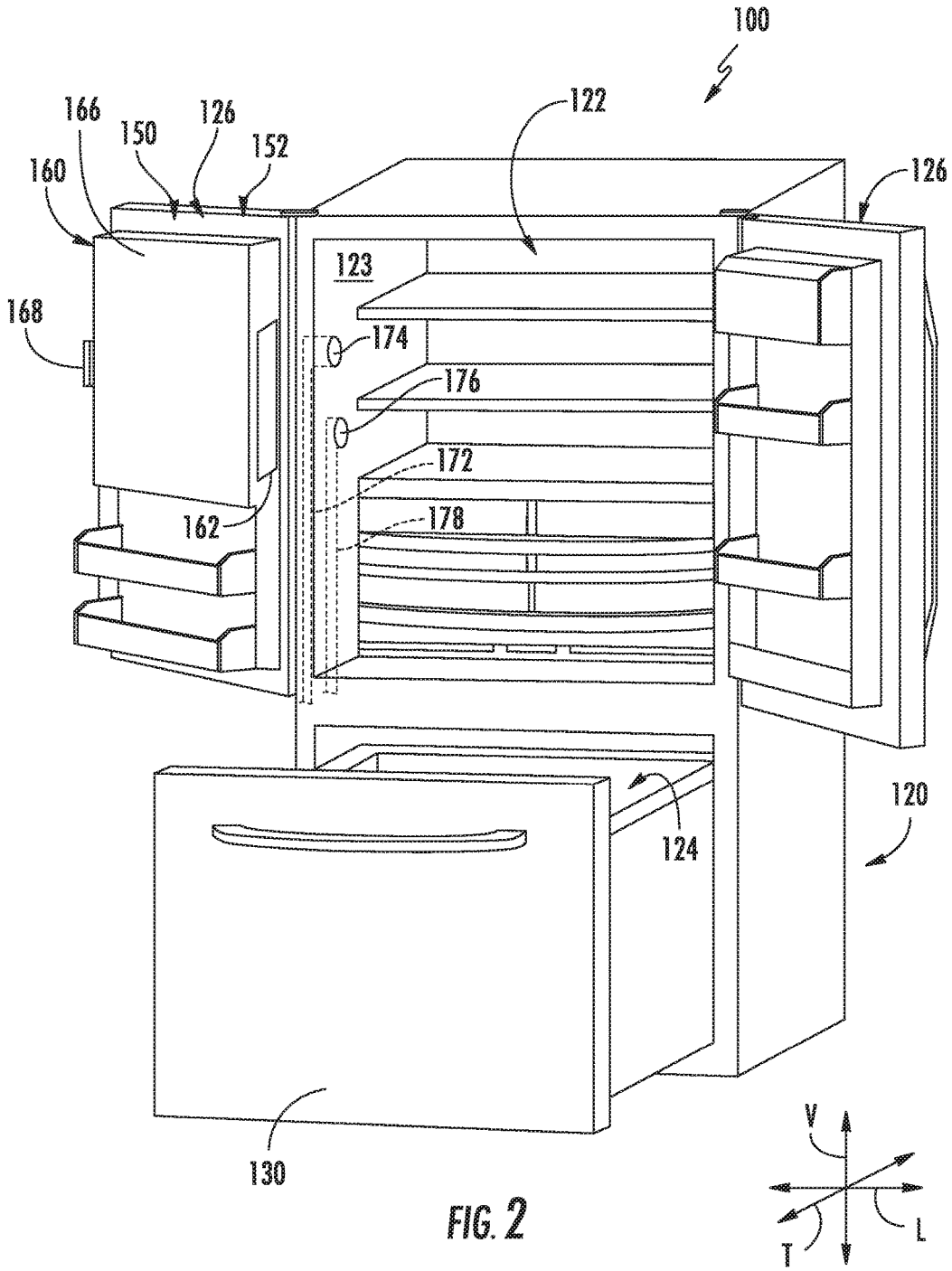
FIG. 2 provides a front perspective view of the exemplary refrigerator appliance of FIG. 1 with refrigerator doors of the refrigerator appliance shown in an open configuration to reveal a fresh food chamber and freezer chamber of the refrigerator appliance.

FIG. 2 is a perspective view of refrigerator appliance 100 having refrigerator doors 126 in an open position to reveal the interior of the fresh food chamber 122. Additionally, freezer door 130 is shown in an open position to reveal the interior of the freezer chamber 124.

Figure 3:
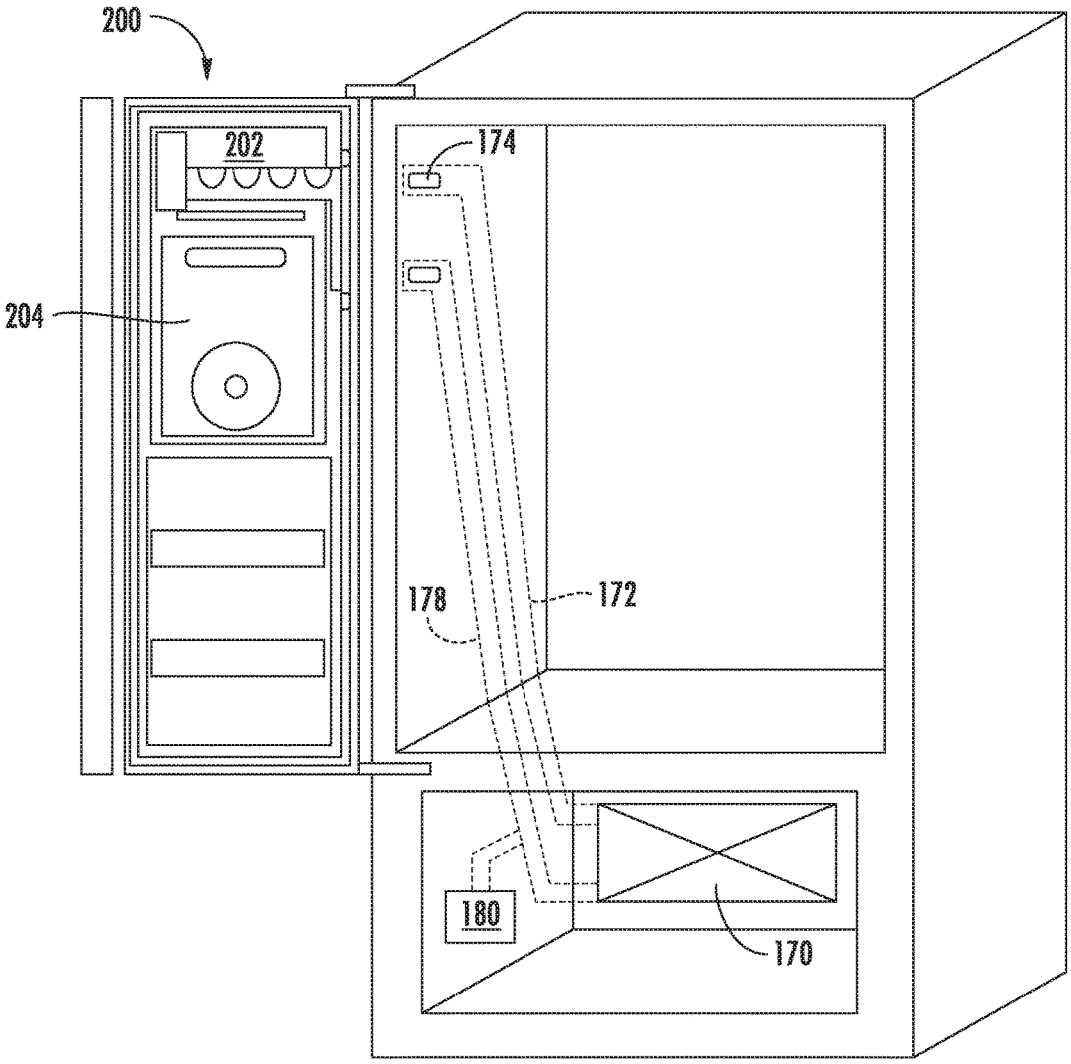
FIG. 3 provides a partial schematic view of an ice making system in a refrigerator door of the exemplary refrigerator appliance of FIG. 1 according to an exemplary embodiment of the present subject matter.

Referring now to FIGS. 2 and 3, a door 126 of the refrigerator appliance 100 may include an inner surface 150 and an outer surface 152. The inner surface 150 generally assists with defining the interior of the fresh food chamber 122 when the door 126 is in a closed position as shown in FIG. 1, while the outer surface 152 is generally opposite the inner surface 150 and assists with defining the exterior of the refrigerator appliance 100.

As shown for example in FIG. 3, an ice making system 200 may be provided outside of the freezer chamber 124 and proximate to the fresh food chamber 122, e.g., in one of the doors 126, such as disposed in a compartment 160, which may be referred to as an icebox compartment 160, defined at the inner surface 150 of one of the doors 126. In such embodiments, the ice making system 200 may be disposed at least partially within the fresh food chamber 122 when the door 126 is in the closed position. Ice making system 200 may include an ice making chamber 202 where ice may be formed in a mold body 208. Ice making system 200 may also include an ice storage bin 204 disposed in communication with the mold body 208, e.g., below mold body 208, for receipt and storage of ice once the ice has been formed in mold body 208.

The ice making system 200 may, as discussed herein, be in thermal communication with freezer chamber 124. In some exemplary embodiments, the ice making chamber 202 may not be in fluid communication with the freezer chamber 124. In other words, in such embodiments, the ice making chamber 202 may be isolated from the freezer chamber. For example, in such embodiments, thermal communication between ice making system 200 and freezer evaporator 170 may be by convection, i.e., air flow, from evaporator 170 to a heat exchanger 206 and by conduction from heat exchanger 206 to the mold body 208 in the ice making chamber 202. Providing cold air from the evaporator 170 to heat exchanger 206 rather than directly into ice making chamber 202 may permit more efficient thermal energy transfer from the cold air to the ice maker mold body 208. That is, rather than circulating cold air above the mold body 208, impinging a flow of cold air on the heat exchanger 206 which is in direct conductive thermal communication with the mold body 208 allows the cold air to more directly influence the mold body 208. As a result, the ice making system 200 may be more efficient and provide faster ice production.

In general, the ice making system 200 and various components thereof, may be provided with insulation 164 (FIG. 4) to reduce heat exchange between the ice making system 200 and the fresh food chamber 122 as well as between ice making system 200 and the ambient environment, e.g., such that the temperature within ice making chamber 202 and ice storage bin 204 can be maintained at levels different from, e.g., cooler than, the temperature in the fresh food chamber 122 and the ambient environment. The ice compartment 160 may include a heat exchange opening 162. The ice maker compartment 160 may be otherwise completely enclosed by insulation 164, except at the heat exchange opening 162. In exemplary embodiments, various features for providing access to ice stored in the ice storage bin may be provided. In one example, an insulated door may be provided in the compartment 160 for access to the ice storage bin. In other embodiments, the outer surface of door 126 may include a dispenser feature, as is generally understood by those skilled in the art, which extends through the insulation 164.

Turning back to FIG. 1, in some exemplary embodiments, ice from storage bin 204 may be supplied to dispenser recess 140 on the outer surface 152 of refrigerator door 126. In such embodiments, refrigerator appliance 100 may include a dispenser assembly, e.g., for delivering or dispensing ice. Dispenser assembly may include a dispenser 142 positioned on or mounted to an exterior portion of refrigerator appliance 100, e.g., on one of refrigerator doors 126. Dispenser 142 may include a discharging outlet 144 for accessing ice. An actuating mechanism 146, shown as a paddle, may be mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. Discharging outlet 144 and actuating mechanism 146 may be external parts of dispenser 142 which may be mounted in a dispenser recess 140. Dispenser recess 140 may be positioned at a predetermined elevation convenient for a user to access ice or water and enabling the user to access ice without the need to bend-over and without the need to open refrigerator doors 126. In some exemplary embodiments, dispenser recess 140 may be positioned at a level that approximates the chest level of a user.

In some exemplary embodiments, an access door—e.g., icebox door 166 (FIG. 2)—may be hinged to icebox compartment 160 to selectively cover or permit access to opening of icebox compartment 160. In such embodiments, icebox door 166 permits selective access to icebox compartment 160. Any manner of suitable latch 168 may be provided with icebox compartment 160 to maintain icebox door 166 in a closed position. In some exemplary embodiments, latch 168 may be actuated by a consumer in order to open icebox door 166 for providing access into icebox compartment 160. In exemplary embodiments which include icebox door 166, insulation 164 is provided throughout icebox door 166 for thermally isolating or insulating icebox compartment 160 from fresh food chamber 122.

Figure 4:
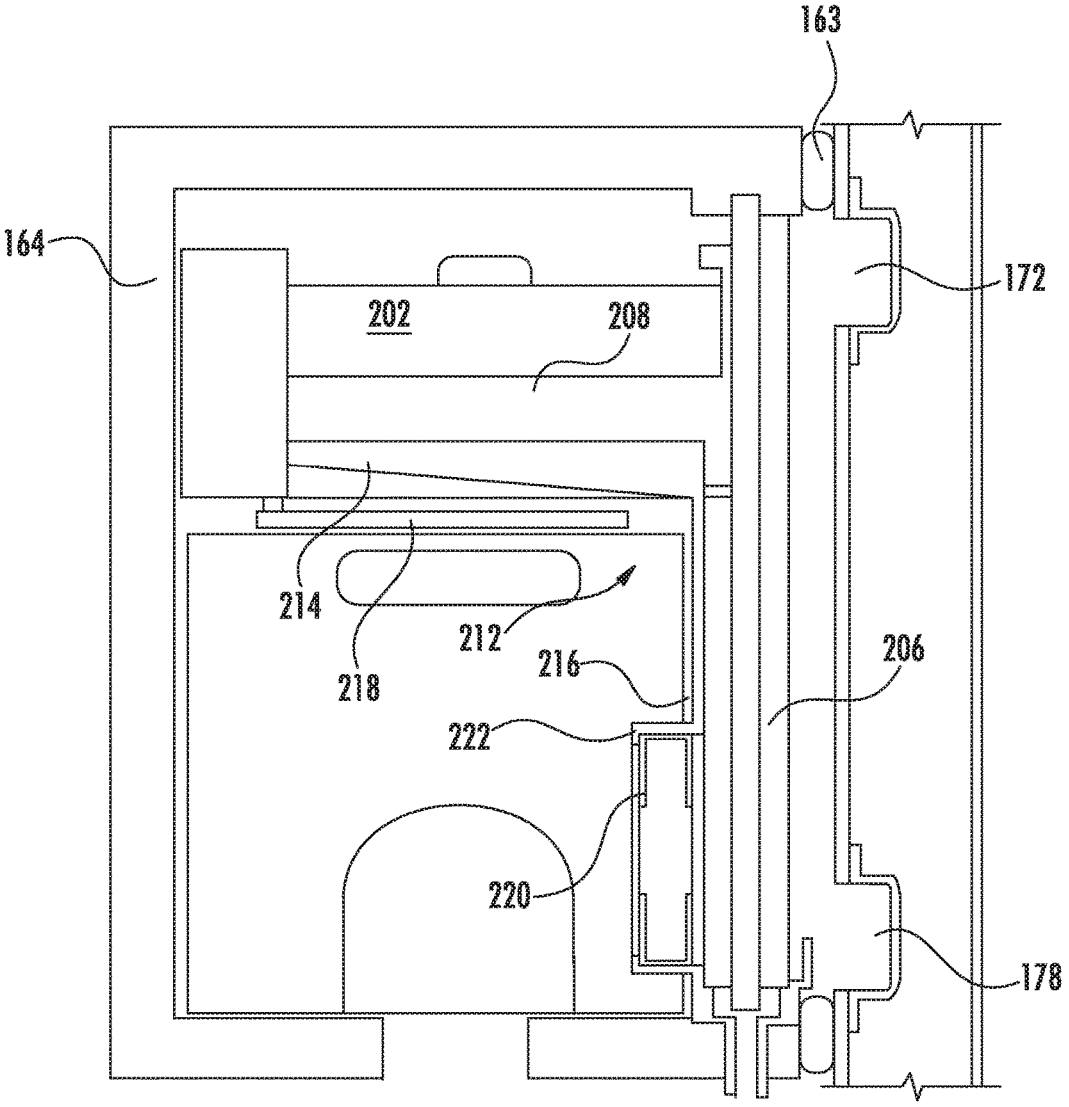
FIG. 4 provides a partial section view of the ice making system of FIG. 3.
Figure 5:
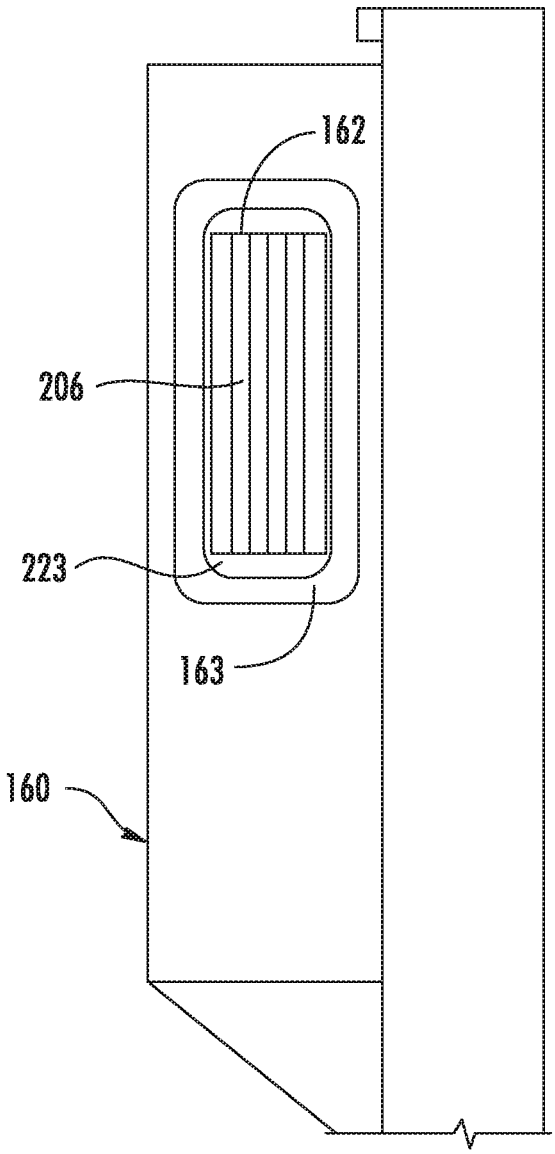
FIG. 5 provides a partial side view of the ice making system and the refrigerator door of FIG. 3.

In some embodiments, for example as illustrated in FIGS. 4 and 5, a gasket 163 may be provided at an outer surface of the icebox compartment 160. The gasket 163 may enclose heat exchange opening 162. When the door 126 is in a closed position, gasket 163 may sealingly engage a side wall 123 of the fresh food chamber 122 to prevent air leakage when the door 126 is in a closed position. For example, gasket 163 may help to prevent or minimize cold air flowing between supply duct 172 and return duct 178 from escaping into the fresh food chamber 122 and/or relatively warm, humid air from fresh food chamber 122 from entering return duct 178 or contacting heat exchanger 206. In alternative embodiments, gasket 163 may be positioned on side wall 123 of the fresh food chamber 122 and extend between side wall 123 and the outer surface of the icebox compartment 160 at heat exchange opening 162 when door 126 is in the closed position.

Various components may be utilized to facilitate the temperature variance between ice making system 200 and fresh food chamber 122. For example, in one embodiment, ice making system 200 may be in fluid communication with the freezer chamber 124. As shown, e.g., in FIGS. 2 and 3, in some embodiments, the ice making system 200 may be in fluid communication with an evaporator 170 which may be disposed in or near the freezer chamber 124. In some embodiments, supply duct 172 and return duct 178 may extend between and provide the thermal communication between the ice making system 200 and freezer chamber 124. Such communication between evaporator 170 and ice making system 200 may be provided or enhanced by various air movers, such as a blower or fan 180, connected to one or the other of supply duct 172 and return duct 178. Supply duct 172 may include, for example, supply outlet 174 supplying cold air from freezer chamber 124 to an exterior portion of ice making system 200. Return duct 178 may include, for example, return inlet 176 flowing air from ice making system 200 to freezer chamber 124. Ducts 172 and 178 may generally be disposed within the refrigerator appliance 100, such as within the various walls defining the chambers 122, 124. In some exemplary embodiments, the ducts 172 and 178 may be foamed in place within the various walls of the refrigerator appliance 100.

The ice making system 200 may be in convective thermal communication with the freezer chamber 124. In some embodiments, such convective thermal communication may be provided by the circulation system 170 which circulates cold air from the freezer chamber 124 to the ice making system 200 and in particular to a heat exchanger 206 thereof, which heat exchanger 206 may be positioned at the heat exchange opening 162 of the icebox compartment 160. In some embodiments, the heat exchanger 206 does not include or employ liquid refrigerant, the circulation of cold air alone cools the heat exchanger 206.

Figure 6:
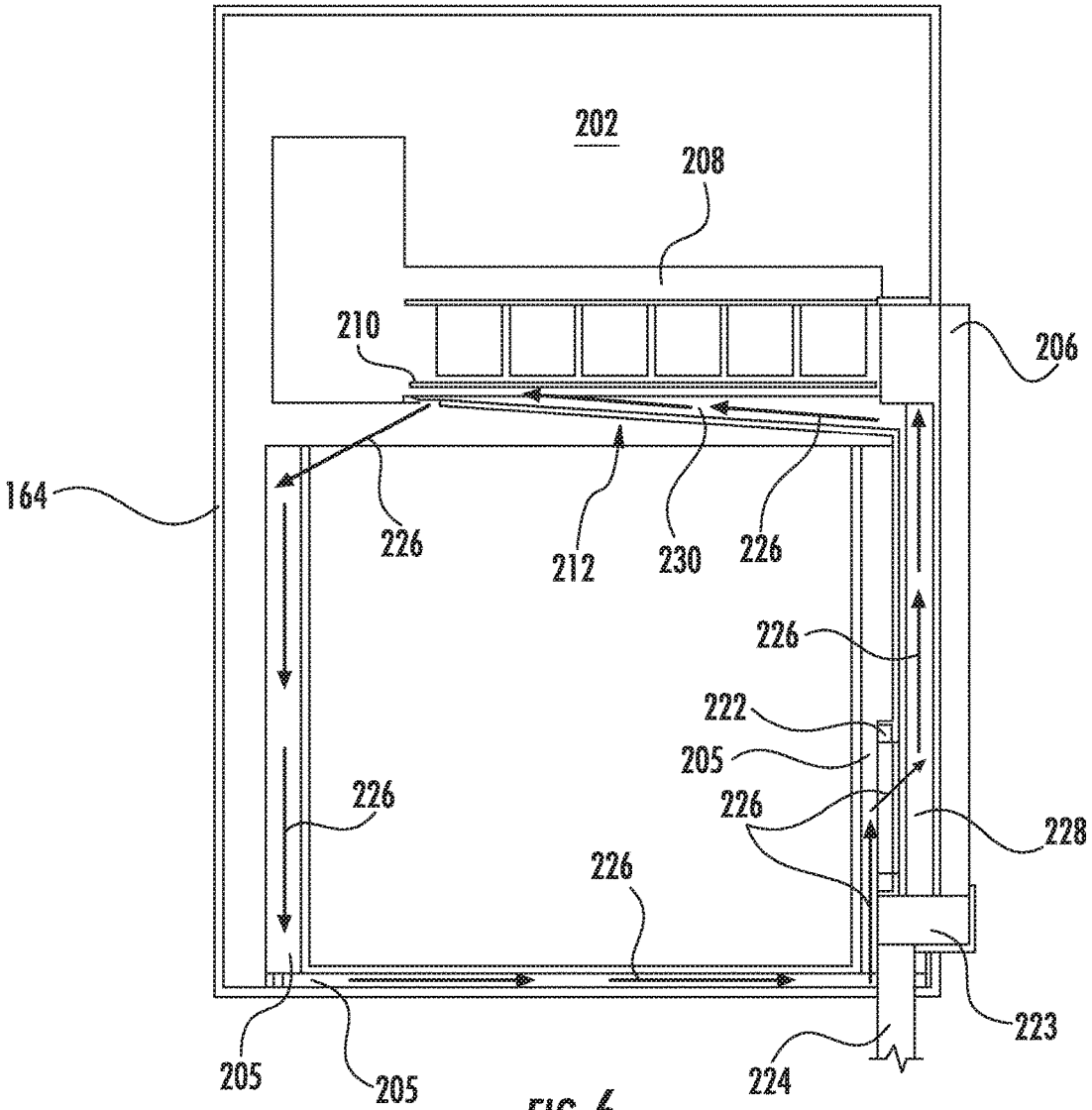
FIG. 6 provides a partial section view of the ice making system of FIG. 3.

In some exemplary embodiments, the ice maker 200 may include a mold body 208 configured for receiving liquid water and forming ice in the mold body 208. The mold body 208 may be so configured by forming the mold body 208 with a series of impressions or recesses which receive liquid water therein and hold the liquid water at least until the liquid water freezes. In some exemplary embodiments, the ice maker 200 may include features for harvesting the ice from the mold body 208 once it has been formed, as well as features for storing and/or dispensing the harvested ice. As described above, the ice maker 200 may include a storage bin 204 within the icebox compartment 160, e.g., below the mold body 208. The mold body 208 may be in thermal communication with a harvest heater 210, such as an electric resistance heating element. The harvest heater 210 may be positioned near a bottom portion of the mold body 208. For example, as illustrated in FIG. 6, the harvest heater 210 may be embedded in the mold body 208. In some embodiments, the harvest heater 210 may heat the mold body 208 to release ice formed within the impressions or recesses of the mold body 208 for harvest. In some embodiments, a level sensor 218, such as an optical sensor or sweep arm, may be provided to sense when the level of ice in storage bin 204 reaches or nears a maximum fill level of the storage bin 204.

In some exemplary embodiments, such as is illustrated in FIG. 4, the ice maker 200 may also include a defrost conduit 212. In such embodiments, the defrost conduit 212 may have a first portion 214 positioned below the mold body 208 and above the storage bin 204 with a second portion 216 positioned between the ice storage bin 204 and the heat exchanger 206. In some exemplary embodiments, the first portion 214 of the defrost conduit 212 extends generally perpendicularly to a vertical direction, e.g., along the lateral direction L or the transverse direction T, and slopes towards the second portion 216 of the defrost conduit 212. For example, in embodiments wherein the icebox compartment 160 is disposed on a rotatable door 126, the first portion 214 of the defrost conduit 212 will extend along the lateral direction L when door 126 is in the closed position. Also in such embodiments, when door 126 is rotated about its hinges by ninety degrees, the first portion 214 of the defrost conduit 212 will extend along the transverse direction T. In either of the foregoing examples, or in other positions within the range of motion of door 126 about its hinges, the first portion 214 extends generally perpendicularly to the vertical direction V. The second portion 216 of the defrost conduit 212 may extend along the vertical direction between the first portion 214 of the defrost conduit 212 and a drain conduit 224. Also, a fluid path may be defined between the second portion 216 of the defrost conduit 212 and the heat exchanger 206, e.g., within first interstice 228 (FIG. 6).

In some exemplary embodiments, the icebox compartment 160 may be a sealed compartment, e.g., the icebox compartment 160 may be generally airtight. In such embodiments, the heat exchanger 206 and the drain conduit 224 may occlude air flow through the heat exchange opening 162. As illustrated in, e.g., FIG. 4, in some exemplary embodiments, the heat exchanger 206 may have two sides, such as an outside facing away from the sealed icebox compartment 160 and an inside extending into the sealed icebox compartment 160. As illustrated in, e.g., FIG. 6, in some exemplary embodiments, the drain conduit 224 may include a drain cup 223, the drain cup 223 may be sealingly engaged with the second portion 216 of the defrost conduit 212 and the drain cup 223 may also be sealingly engaged with a lower portion of the heat exchanger 206 at the outside of the heat exchanger 206. Further, the second portion 216 of the defrost conduit 212 may be sealingly engaged with the heat exchanger 206 at the inside of the heat exchanger 206. Additionally, in such embodiments where the drain conduit 224 includes a drain cup 223, the drain cup 223 and the heat exchanger 206 may each be sealingly engaged with the heat exchange opening 162 such that the drain cup 223 and the heat exchanger 206 occlude air flow through the heat exchange opening 162.

Also in such exemplary embodiments where the compartment 160 is a sealed icebox compartment 160, when a compartment door 166 and/or dispenser 142 is or are provided, the compartment door 166 and/or dispenser 142 may be configured to sealingly engage with corresponding portions of the sealed icebox compartment 160 when in a closed position to maintain airtightness of the sealed icebox compartment 160, e.g., seals or gaskets as are generally known in the art may be provided on or in association with the compartment door 166 and/or dispenser 142.

Figure 7:
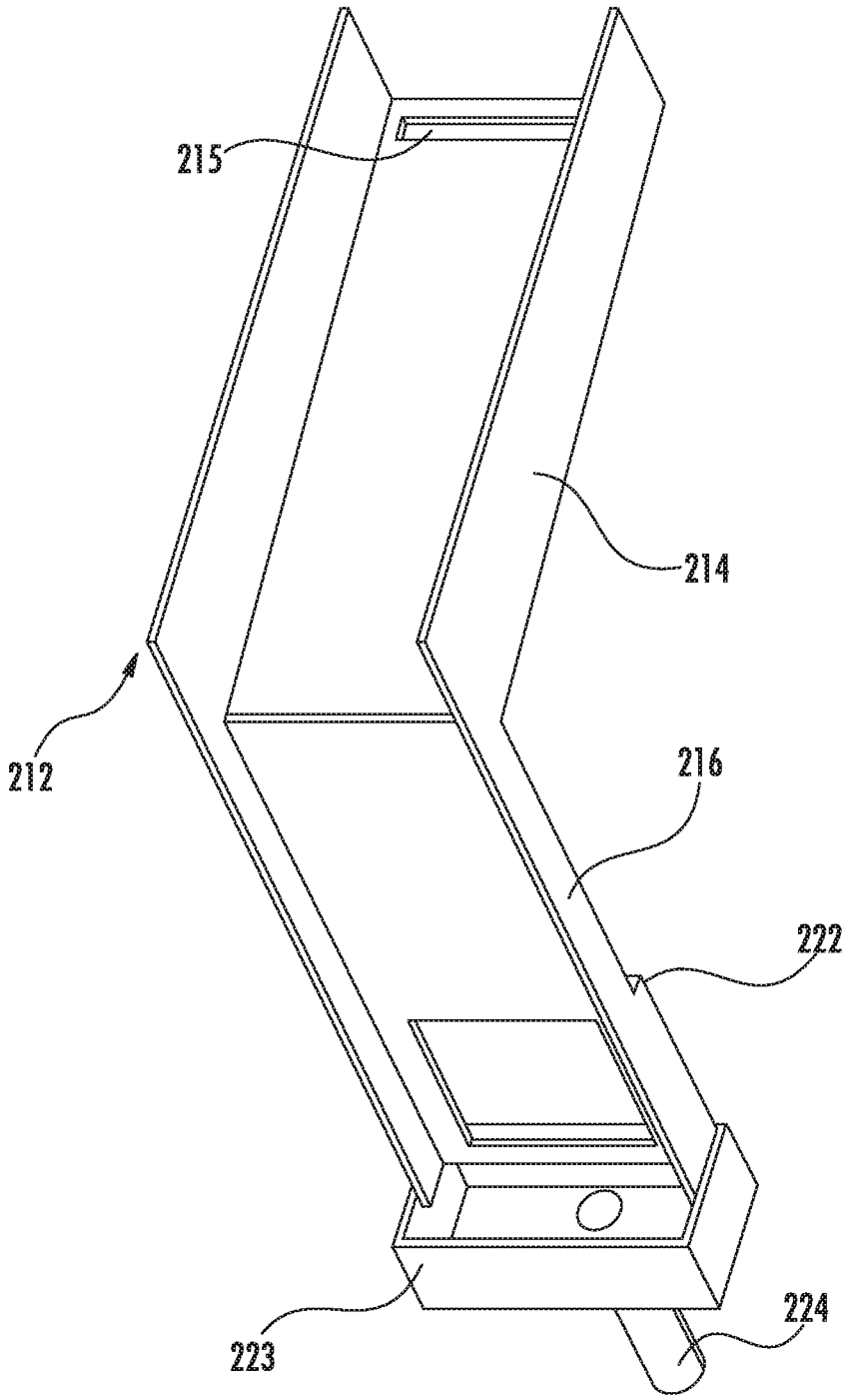
FIG. 7 provides a perspective view of a defrost conduit and a drain conduit of the ice making system of FIG. 3.

Further, in some exemplary embodiments wherein the icebox compartment is sealed against outside air, an internal air circulation conduit may be included for providing air circulation within the sealed icebox compartment 160. Such air circulation conduit may advantageously help to provide a more even temperature distribution throughout the icebox compartment 160. In some exemplary embodiments, e.g., as illustrated in FIG. 6, the air circulation conduit may include multiple distinct portions. That is, in such exemplary embodiments, the ice storage bin 204 may have one or more peripheral air flow conduits or channels 205 extending at least partially along three sides of the ice storage bin 204 which form portions of the air circulation conduit. In such exemplary embodiments, the air circulation conduit may extend through the air flow channels 205 of the ice storage bin 204 into a first interstice 228, then into a second interstice 230, and through a vent 215 (FIG. 7) in the first portion 214 of the defrost conduit 212. The first interstice may be between the second portion 216 of the defrost conduit 212 and the heat exchanger 206 and the second interstice may be between the first portion 214 of the defrost conduit 212 and the mold body 208. In some embodiments, a fan 220 (FIG. 4) may be provided. The fan 220 may be disposed proximate to a lower portion of the ice storage bin 204 and the fan 220 may be configured for drawing air 226 (FIG. 6) from the peripheral air flow channel(s) 205 of the ice storage bin 204 into the first interstice between the second portion 216 of the defrost conduit 212 and the heat exchanger 206. In some embodiments, the fan 220 may be disposed in a housing 222 and the housing 222 may be integrally formed with the second portion 216 of the defrost conduit 212.

As noted above, a harvest heater 210 may be provided. In such exemplary embodiments, the harvest heater 210 may be configured to at least partially defrost the mold body 208 and the heat exchanger 206. Thus, harvest heater 210 may be operable to heat and thereby defrost the mold body 208 and the heat exchanger 206. In such exemplary embodiments, the defrost conduit 212 may be configured to convey frost melt water generated from the mold body 208 to the drain conduit 224. Similarly, the defrost conduit 212 may convey frost melt water generated from the heat exchanger 206 to the drain conduit 224.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making appliance, comprising:

a sealed icebox compartment including a heat exchange opening;

an ice maker disposed within the sealed icebox compartment, the ice maker comprising a heat exchanger positioned at the heat exchange opening of the sealed icebox compartment, wherein the ice maker further comprises a mold body configured for receiving liquid water and forming ice;

an air circulation conduit providing air circulation within the sealed icebox compartment;

a defrost conduit comprising a first portion positioned below the mold body, the first portion of the defrost conduit sloping towards a second portion of the defrost conduit, the second portion of the defrost conduit extending along the vertical direction between the first portion of the defrost conduit and a drain conduit; and an ice storage bin disposed within the sealed icebox compartment below the first portion of the defrost conduit, the ice storage bin defines a peripheral air flow channel extending at least partially along three sides of the ice storage bin, the air circulation conduit extending through the peripheral air flow channel of the ice storage bin, into a first interstice between the second portion of the defrost conduit and the heat exchanger, into a second interstice between the first portion of the defrost conduit and the mold body, and through a vent in the first portion of the defrost conduit.

2. The ice making appliance of claim 1, further comprising a fan disposed proximate to a lower portion of the ice storage bin, the fan configured for drawing air from the peripheral air flow channel of the ice storage bin into the first interstice.

3. The ice making appliance of claim 2, wherein the fan is disposed in a housing, the housing integrally formed with the second portion of the defrost conduit.

4. A refrigerator appliance, comprising:

a cabinet defining a fresh food chamber and a freezer chamber, the freezer chamber positioned below the fresh food chamber along a vertical direction, the cabinet also defining a sealed icebox compartment outside of the freezer chamber and proximate to the fresh food chamber, the sealed icebox compartment including a heat exchange opening;

an ice maker disposed within the sealed icebox compartment, the ice maker comprising a heat exchanger positioned at the heat exchange opening of the icebox compartment and a mold body configured for receiving liquid water and forming ice;

a defrost conduit comprising a first portion positioned below the mold body, the first portion of the defrost conduit sloping towards a second portion of the defrost conduit, the second portion of the defrost conduit extending along a vertical direction between the first portion of the defrost conduit and a drain conduit;

an air circulation conduit providing air circulation within the sealed icebox compartment; and an ice storage bin disposed within the icebox compartment below the first portion of the defrost conduit, the second portion of the defrost conduit positioned between the ice storage bin and the heat exchanger, a fluid path defined between the second portion of the defrost conduit and the heat exchanger, wherein the ice storage bin defines a peripheral air flow channel extending at least partially along three sides of the ice storage bin, the air circulation conduit extending through the air flow channel of the ice storage bin, into a first interstice between the second portion of the defrost conduit and the heat exchanger, into a second interstice between the first portion of the defrost conduit and the mold body, and through a vent in the first portion of the defrost conduit.

5. The refrigerator appliance of claim 4, wherein the heat exchanger and the drain conduit occlude air flow through the heat exchange opening.

6. The refrigerator appliance of claim 4, further comprising a harvest heater positioned near a bottom portion of the mold body, wherein the harvest heater is configured to at least partially defrost the mold body and the heat exchanger, and wherein the defrost conduit is configured to convey frost melt water generated from the mold body and the heat exchanger to the drain conduit.

7. The refrigerator appliance of claim 6, further comprising a fan disposed proximate to a lower portion of the ice storage bin, the fan configured for drawing air from the peripheral air flow channel of the ice storage bin into the first interstice.

8. The refrigerator appliance of claim 7, wherein the fan is disposed in a housing, the housing integrally formed with the second portion of the defrost conduit.

9. The refrigerator appliance of claim 6, wherein the heat exchanger comprises an outside facing away from the sealed icebox compartment and an inside extending into the sealed icebox compartment, and the drain conduit comprises a drain cup, the drain cup sealingly engaged with the second portion of the defrost conduit and the drain cup sealingly engaged with a lower portion of the heat exchanger at the outside of the heat exchanger.

10. The refrigerator appliance of claim 9, wherein the second portion of the defrost conduit is sealingly engaged with the heat exchanger at the inside of the heat exchanger.

11. The refrigerator appliance of claim 10, wherein the drain cup is sealingly engaged with the heat exchange opening and the heat exchanger is sealingly engaged with the heat exchange opening such that the drain cup and the heat exchanger occlude air flow through the heat exchange opening.

* * * * *